US010968498B2

(12) United States Patent
Shin et al.

(10) Patent No.: US 10,968,498 B2
(45) Date of Patent: Apr. 6, 2021

(54) HIGH-STRENGTH COLD-ROLLED STEEL SHEET WITH EXCELLENT WORKABILITY AND MANUFACTURING METHOD THEREFOR

(71) Applicant: Hyundai Steel Company, Incheon (KR)

(72) Inventors: Hyo Dong Shin, Dalseo-Gu (KR); Hyun Yeong Jung, Dangjin-Si (KR); Sung Yul Huh, Suwon-Si (KR)

(73) Assignee: Hyundai Steel Company, Incheon (KR)

( * ) Notice: Subject to any disclaimer, the term of this patent is extended or adjusted under 35 U.S.C. 154(b) by 237 days.

(21) Appl. No.: 16/311,610

(22) PCT Filed: Apr. 21, 2017

(86) PCT No.: PCT/KR2017/004294
§ 371 (c)(1),
(2) Date: Dec. 19, 2018

(87) PCT Pub. No.: WO2017/222159
PCT Pub. Date: Dec. 28, 2017

(65) Prior Publication Data

US 2019/0203310 A1 Jul. 4, 2019

(30) Foreign Application Priority Data

Jun. 21, 2016 (KR) ..... 10-2016-0077453

(51) Int. Cl.
*C21D 8/02* (2006.01)
*C22C 38/02* (2006.01)
(Continued)

(52) U.S. Cl.
CPC ..... *C21D 8/0247* (2013.01); *C21D 8/02* (2013.01); *C21D 9/46* (2013.01); *C22C 38/02* (2013.01);
(Continued)

(58) Field of Classification Search
CPC ..... C21D 8/0247; C21D 8/02; C21D 9/46; C22C 38/02; C22C 38/04
See application file for complete search history.

(56) References Cited

U.S. PATENT DOCUMENTS

2018/0002771 A1* 1/2018 Han ..... C21D 8/0226

FOREIGN PATENT DOCUMENTS

CN 101326299 A 12/2008
CN 107002207 A 8/2017
(Continued)

OTHER PUBLICATIONS

JP2015113505A English translation by machine. (Year: 2020).*
(Continued)

*Primary Examiner* — Christopher S Kessler
*Assistant Examiner* — Jiangtian Xu
(74) *Attorney, Agent, or Firm* — Locke Lord LLP

(57) ABSTRACT

A method for manufacturing a high-strength cold-rolled steel sheet according to an embodiment includes the steps of: reheating a steel slab, which includes 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), and the remainder being iron (Fe) and inevitable impurities, at a temperature of 1150° C. to 1250° C.; hot-rolling the reheated slab in such a manner as to reach a finishing mill delivery temperature of 800° C. to 900° C.; cooling the hot-rolled slab to a temperature of 600° C. to 700° C. and coiling the cooled slab,
(Continued)

thereby obtaining a hot-rolled steel sheet; pickling the hot-rolled steel sheet, followed by cold rolling; annealing the cold-rolled steel sheet in a two-phase region of α and γ phases; and cooling the annealed steel sheet to the martensite temperature range, followed by overaging.

8 Claims, 12 Drawing Sheets

(51) Int. Cl.

| | |
|---|---|
| ***C22C 38/06*** | (2006.01) |
| ***C22C 38/22*** | (2006.01) |
| ***C22C 38/38*** | (2006.01) |
| ***C22C 38/60*** | (2006.01) |
| ***C22C 38/04*** | (2006.01) |
| ***C21D 9/46*** | (2006.01) |

(52) U.S. Cl.

CPC ..... *C22C 38/04* (2013.01); *C22C 38/06* (2013.01); *C22C 38/22* (2013.01); *C22C 38/38* (2013.01); *C22C 38/60* (2013.01); *C21D 8/0205* (2013.01); *C21D 8/0226* (2013.01); *C21D 8/0236* (2013.01); *C21D 2211/005* (2013.01); *C21D 2211/008* (2013.01); *C21D 2211/009* (2013.01)

(56) References Cited

FOREIGN PATENT DOCUMENTS

| | | | | | |
|---|---|---|---|---|---|
| EP | 1960562 | B1 | * | 8/2015 | ..... C21D 8/0226 |
| JP | 2006083403 | A | | 3/2006 | |
| JP | 2009518541 | A | | 5/2009 | |
| JP | 2011-068979 | A | | 4/2011 | |
| JP | 2013-049901 | A | | 3/2013 | |
| JP | 2015-113505 | A | | 6/2015 | |
| JP | 2015113505 | A | * | 6/2015 | |
| KR | 10-20140002279 | A | | 1/2014 | |
| KR | 10-20140130492 | A | | 11/2014 | |
| KR | 10-20150130612 | A | | 11/2015 | |
| WO | 2016/167313 | A1 | | 10/2016 | |
| WO | 2017/002883 | A1 | | 1/2017 | |

OTHER PUBLICATIONS

Office Action dated Apr. 7, 2020, issued in the corresponding Chinese Patent Application No. 201780038744.4 and English translation thereof.

Office Action dated Nov. 8, 2019, issued for Japanese patent application No. 2018-564315 and English translation thereof.

* cited by examiner

HIGH-STRENGTH COLD-ROLLED STEEL SHEET WITH EXCELLENT WORKABILITY AND MANUFACTURING METHOD THEREFOR

CROSS REFERENCE TO RELATED APPLICATIONS

This application is a national phase entry under 35 U.S.C. § 371 of PCT International Application No. PCT/KR2017/004294, filed Apr. 21, 2017, which claims the benefit of and priority to Korean Patent Application No. 10-2016-0077453 filed on Jun. 21, 2016. The entire contents of these patent applications are hereby incorporated by reference.

TECHNICAL FIELD

The present invention relates to a cold-rolled steel sheet and a method for manufacturing the same, and more particularly to a high-strength cold-rolled steel sheet having excellent workability and a method for manufacturing the same.

BACKGROUND ART

As competition in the automobile industry becomes more and more intense, there is a growing demand for higher automobile quality and diversification. In addition, in order to meet the regulations on passenger safety and environmental standards being strengthened and to improve fuel efficiency, it is sought to reduce automobile weight and increase strength.

As a steel sheet for an automotive exterior panel, a cold-rolled steel sheet having excellent workability and elongation is mainly applied. A method for manufacturing a high-strength cold-rolled steel sheet for automotive applications generally includes hot-rolling, cold-rolling and annealing processes.

Related prior-art documents include Korean Patent Application Publication No. 10-2014-0002279 (published on Jan. 8, 2014; entitled "High-strength cold-rolled steel sheet and method for manufacturing the same").

DISCLOSURE

Technical Problem

The present invention is intended to provide a method for reducing the difference in properties between the edge and center of a hot-rolled steel sheet after hot-rolling coiling.

The present invention is intended to provide a cold-rolled steel sheet having high tensile strength and yield strength and excellent bending workability, and a method for manufacturing the same.

Technical Solution

A method for manufacturing a high-strength cold-rolled steel sheet according to one aspect of the present invention comprises the steps of: reheating a steel slab, which includes 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), and the remainder being iron (Fe) and inevitable impurities, at a temperature of 1150° C. to 1250° C.; hot-rolling the reheated slab in such a manner as to reach a finishing mill delivery temperature of 800° C. to 900° C.; cooling the hot-rolled slab to a temperature of 600° C. to 700° C., followed by coiling, thereby obtaining a hot-rolled steel sheet; pickling the hot-rolled steel sheet, followed by cold rolling; annealing the cold-rolled steel sheet in a two-phase region composed of α and γ phases; and cooling the annealed steel sheet to the martensite temperature range, followed by overaging.

In one embodiment, the steel slab may further include at least one of 0.35 wt % to 0.45 wt % aluminum (Al), more than 0 wt % but not more than 0.02 wt % phosphorus (P), and more than 0 wt % but not more than 0.003 wt % sulfur (S).

In another embodiment, the hot-rolled steel sheet after the hot-rolling may have a microstructure composed of pearlite and ferrite.

In still another embodiment, the difference in tensile strength between the center and widthwise edge of the hot-rolled steel sheet may be 50 MPa or less.

In still another embodiment, the annealing may be performed at 810° C. to 850° C., and the overaging may be performed at 250° C. to 350° C.

A high-strength cold-rolled steel sheet according to another aspect of the present invention includes 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), and the remainder being iron (Fe) and inevitable impurities, and has a complex microstructure composed of ferrite, martensite and bainite, wherein the sum of the area fractions of the ferrite and the martensite is 90% to less than 100%.

In one embodiment, the high-strength cold-rolled steel sheet may further include at least one of 0.35 wt % to 0.45 wt % aluminum (Al), more than 0 wt % but not more than 0.02 wt % phosphorus (P), and more than 0 wt % but not more than 0.003 wt % sulfur (S).

In another embodiment, the high-strength cold-rolled steel sheet may have a tensile strength of 980 MPa or higher, a yield strength of 600 MPa or higher, an elongation of 17% or higher, and a bending workability (R/t) of 2.0 or less.

Advantageous Effects

According to embodiments of the present invention, the difference in tensile strength between the edge and center of a hot-rolled steel sheet after hot-rolling coiling may be reduced by setting the coiling temperature of the hot-rolling process at 600° C. to 700° C.

According to embodiments of the present invention, the internal oxidation depth of the hot-rolled steel sheet may increase due to an increase in the coiling temperature. Due to this increase in the internal oxidation depth, a color difference on the surface of the final cold-rolled steel sheet may occur. According to embodiments of the present invention, the internal oxidation depth of the hot-rolled steel sheet may be reduced by adding a specific amount of antimony as an alloying element to the steel sheet.

According to embodiments of the present invention, a yield strength of 600 MPa or higher, a tensile strength of 980 MPa or higher, an elongation of 17% or higher and a bending workability (R/t) of 2 or less may be ensured by adjusting alloying elements and controlling annealing process and overaging process conditions.

MODE FOR INVENTION

Figure 1A:
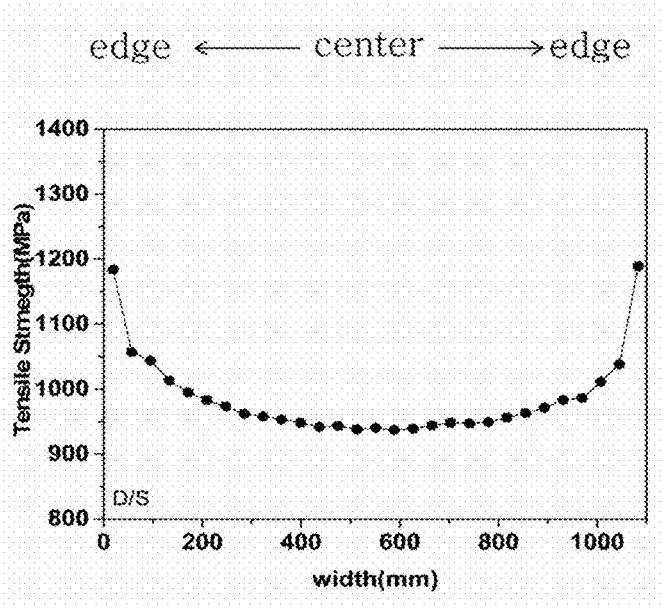
FIG. 1A is a graph showing the change in tensile strength along the widthwise direction of a hot-rolled steel sheet at a coiling temperature of 400° C. in one comparative example of the present invention.

Hereinafter, the present invention will be described in detail such that it may be easily carried out by those skilled in the technical field to which the present invention pertains. The present invention may be embodied in a variety of different forms and is not limited to the embodiments disclosed herein. Throughout the specification, the same reference numerals are used to designate the same or similar components. In addition, the detailed description of known functions and configurations will be omitted when it may unnecessarily obscure the subject matter of the present invention.

The present inventors have found that during the manufacturing of a cold-rolled steel sheet by manufacturing processes, including hot rolling, cold rolling and annealing processes, a great difference in properties between the widthwise edge and center of a hot-rolled steel sheet obtained after performing the hot-rolling coiling process occurs. Accordingly, the present inventors have found that this difference in properties is associated with the coiling temperature of the rolling process.

Specifically, it has been found that after a steel slab, which includes 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), and the remainder being iron (Fe) and inevitable impurities, is reheated and then hot-rolled at a temperature of 800 to 900° C., a great difference in tensile strength between the widthwise edge and center of hot-rolled steel sheet occurs depending on the coiling temperature after cooling.

Figure 1B:
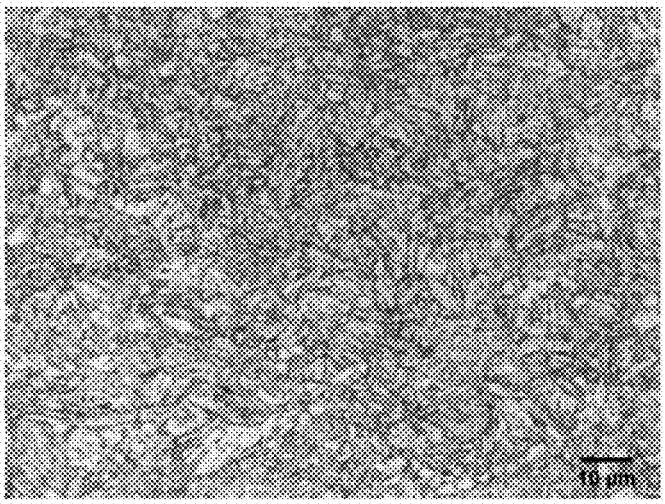
FIG. 1B is a photograph showing the microstructure of the edge of the hot-rolled steel sheet of FIG. 1A.
Figure 1C:
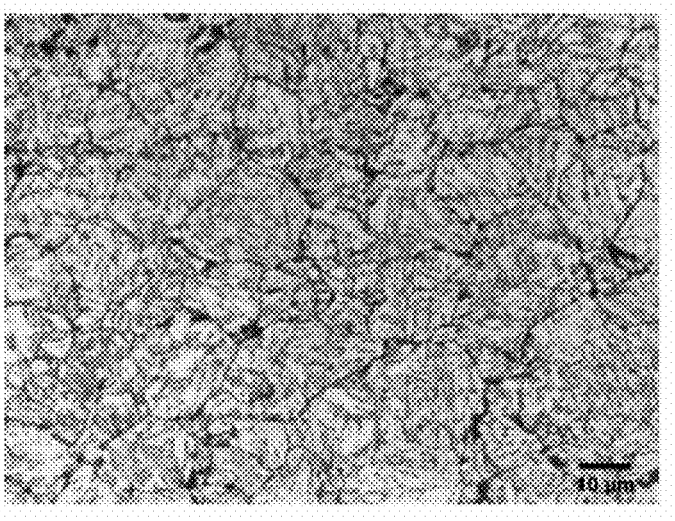
FIG. 1C is a photograph showing the microstructure of the center of the hot-rolled steel sheet of FIG. 1A.

Table 1 below shows the alloy composition of a steel slab as one example, FIG. 1A is a graph showing the change in tensile strength along the widthwise direction of a hot-rolled steel sheet at a coiling temperature of 400° C. in one comparative example of the present invention. FIG. 1B is a photograph showing the microstructure of the edge of the hot-rolled steel sheet of FIG. 1A, and FIG. 1C is a photograph showing the microstructure of the center of the hot-rolled steel sheet of FIG. 1A.

Figure 2A:
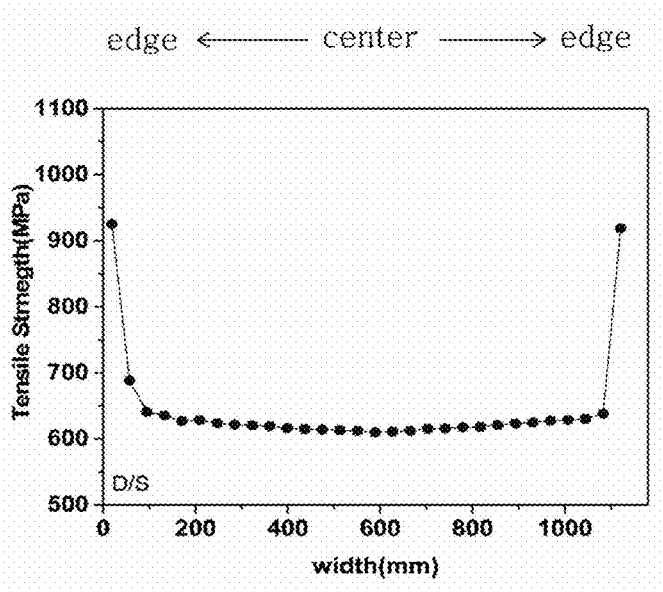
FIG. 2A is a graph showing the change in tensile strength along the widthwise direction of a hot-rolled steel sheet at a coiling temperature of 580° C. in one comparative example of the present invention.
Figure 2B:
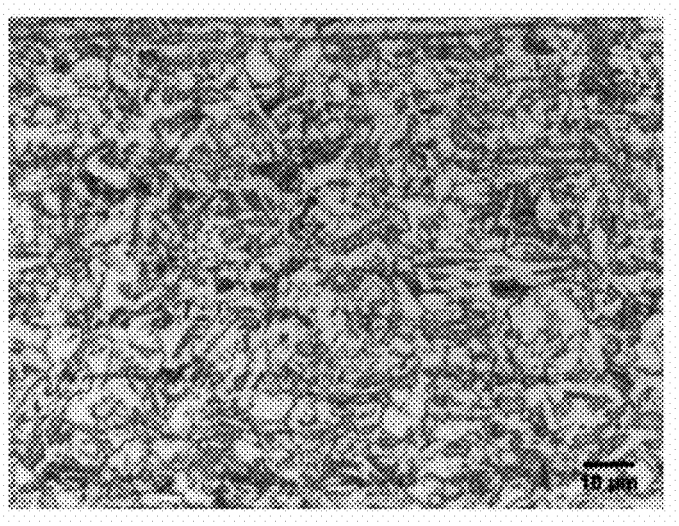
FIG. 2B is a photograph showing the microstructure of the edge of the hot-rolled steel sheet of FIG. 2A.
Figure 2C:
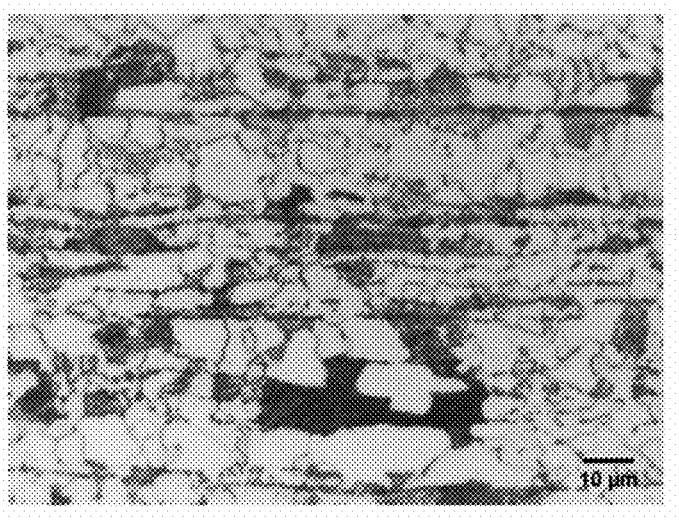
FIG. 2C is a photograph showing the microstructure of the center of the hot-rolled steel sheet of FIG. 2A.

FIG. 2A is a graph showing the change in tensile strength along the widthwise direction of a hot-rolled steel sheet at a coiling temperature of 580° C. in one comparative example of the present invention. FIG. 2B is a photograph showing the microstructure of the edge of the hot-rolled steel sheet of FIG. 2A, and FIG. 2C is a photograph showing the microstructure of the center of the hot-rolled steel sheet of FIG. 2A.

Figure 3A:
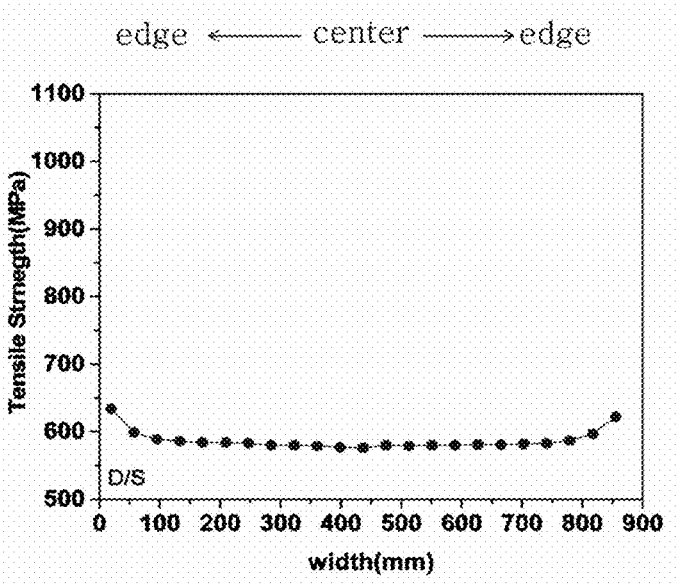
FIG. 3A is a graph showing the change in tensile strength along the widthwise direction of a hot-rolled steel sheet at a coiling temperature of 640° C. in one comparative example of the present invention.
Figure 3B:
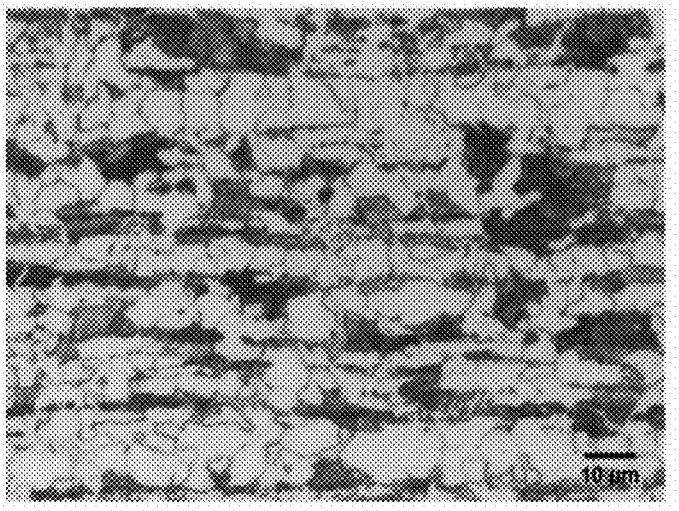
FIG. 3B is a photograph showing the microstructure of the edge of the hot-rolled steel sheet of FIG. 3A.
Figure 3C:
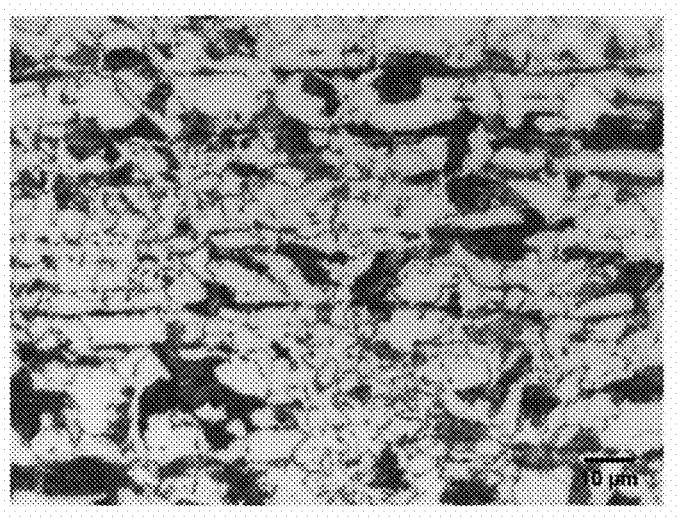
FIG. 3C is a photograph showing the microstructure of the center of the hot-rolled steel sheet of FIG. 3A.

FIG. 3A is a graph showing the change in tensile strength along the widthwise direction of a hot-rolled steel sheet at a coiling temperature of 640° C. in one comparative example of the present invention. FIG. 3B is a photograph showing the microstructure of the edge of the hot-rolled steel sheet of FIG. 3A, and FIG. 3C is a photograph showing the microstructure of the center of the hot-rolled steel sheet of FIG. 3A.

TABLE 1

| C | Si | Mn | Cr | Mo |
|---|---|---|---|---|
| 0.110 | 1.03 | 2.23 | 0.376 | 0.043 |

Referring to FIG. 1A, the different in tensile strength that occurred between the center and edge of the hot-rolled steel sheet was about 200 MPa to 240 MPa. Referring to FIGS. 1B and 1C, the edge was composed of bainite and martensite which are low-temperature phases, and the center was composed of a relatively high fraction of pearlite and a relatively low fraction of bainite and martensite.

Referring to FIG. 2A, the difference in tensile strength that occurred between the center and edge of the hot-rolled steel sheet was about 300 MPa. Referring to FIGS. 2B and 2C, the edge was composed of a relatively high fraction of bainite and a relatively low fraction of ferrite and pearlite, and the center was composed of ferrite and pearlite.

Referring to FIG. 3A, the difference in tensile strength that occurred between the center and edge of the hot-rolled steel sheet was about 45 MPa to about 50 MPa. Referring to FIGS. 3B and 3C, the edge and the center were all composed of pearlite and ferrite.

From the foregoing, it is believed that the difference in properties between different portions of the hot-rolled steel sheet is attributable to the difference in cooling rate between the widthwise positions of the hot-rolled steel sheet after coiling. Namely, it is believed since the center of the hot-rolled steel sheet has low cooling rate and the edge of the hot-rolled steel sheet has a relatively high cooling rate, a low-temperature phase occurs in the edge of the hot-rolled steel sheet. For this reason, in order to reduce the difference in properties between different portions of the hot-rolled steel sheet, the coiling temperature of the hot-rolling process is increased so that pearlite transformation will occur throughout the hot-rolled steel sheet, even though the cooling rate of the edge is relatively high. In one example, the coiling temperature of the hot-rolling process may be set at 600° C. to 700° C.

Meanwhile, the present inventors have found that when the coiling temperature of the hot-rolling temperature is increased to a temperature of 600° C. to 700° C., a color difference occurs locally on the surface of the cold-rolled steel sheet, after the cold-rolled steel sheet is manufactured as a final product. Meanwhile, the present inventors have found that this local color difference is attributable to oxidation of the surface of the hot-rolled steel sheet in the process of cooling the hot-rolled steel sheet after coiling.

Figure 4:
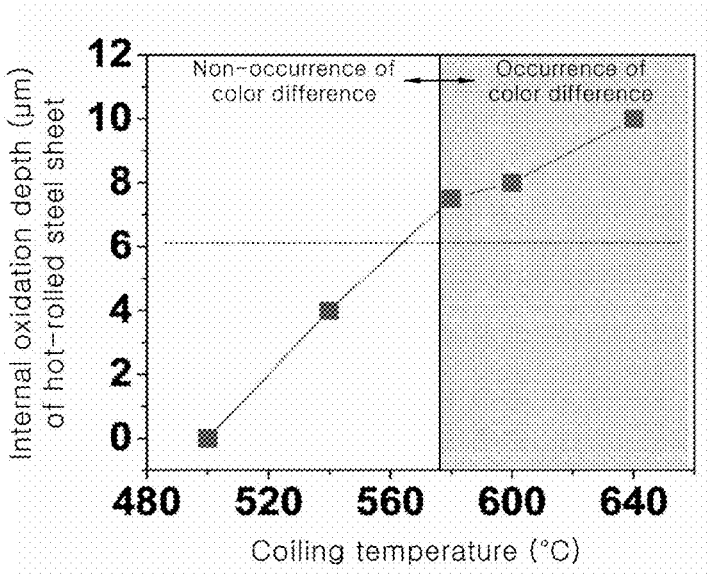
FIG. 4 is a graph showing the internal oxidation depth of a hot-rolled steel sheet as a function of a hot-rolling process in one example of the present invention.

As shown in FIG. 4, the present inventors have found that when the coiling temperature of the hot-rolled steel sheet is 580° C. or higher, a local color difference in the cold-rolled steel sheet occurs. In addition, it has been found that when the coiling temperature of the hot-rolled steel sheet is 580° C. or higher, the internal oxidation depth of the hot-rolled steel sheet is 6 μm or more.

Accordingly, it has been found that, in the process of increasing the coiling temperature to a temperature of 600° C. to 700° C. in order to reduce the difference in tensile strength between the center and edge of the hot-rolled steel sheet, internal oxidation of the hot-rolled steel sheet excessively progresses, and for this reason, a local color difference on the surface of the cold-rolled steel sheet that is a final product may occur.

In conclusion, the present inventors proposes the following alloy composition of a steel sheet in order to maintain the coiling temperature of the hot-rolling process at 600° C. to 700° C. and, at the same time, inhibit internal oxidation of the hot-rolled steel sheet. In addition, the hot-rolled steel sheet having this alloy composition may be manufactured into a high-strength cold-rolled steel sheet through a cold-rolling process, an annealing process and an overaging process. The cold-rolled steel sheet may have a tensile strength of 980 MPa or higher, a yield strength of 600 MPa or higher, an elongation of 17% or higher, and a bending workability (R/t) of 2.0 or less.

High-Strength Cold-Rolled Steel Sheet

A high-strength cold-rolled steel sheet according to one embodiment of the present invention includes 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), and the remainder being iron (Fe) and inevitable impurities. In another embodiment, the high-strength cold-rolled steel sheet may further include at least one of 0.35 wt % to 0.45 wt % aluminum (Al), more than 0 wt % but not more than 0.02 wt % phosphorus (P), and more than 0 wt % but not more than 0.003 wt % sulfur (S).

The high-strength cold-rolled steel sheet may have a tensile strength of 980 MPa or higher, a yield strength of 600 MPa or higher, an elongation of 17% or higher, and a bending workability (R/t) of 2.0 or less. The bending workability (R/t) may be defined as the ratio of the minimum bending curvature radius (R) of a sample, measured when the sample is bent in a range that causes no cracking, to the thickness of the sample.

The high-strength cold-rolled steel sheet may have a complex microstructure composed of ferrite, martensite and bainite, wherein the sum of the area fractions of the ferrite and the martensite may be 90% to less than 100%.

Hereinafter, the function and content of each component included in the alloy composition of the high-strength cold-rolled steel sheet according to the present invention will be described in more detail.

Carbon (C)

Carbon (C) is an alloying element that contributes to increasing martensite fraction and hardness. Carbon (C) is added in an amount of 0.10 wt % to 0.13 wt % based on the total weight of the steel sheet. If the content of carbon (C) is less than 0.10 wt %, it will be difficult to ensure sufficient strength. On the other hand, the content of carbon (C) is more than 0.13 wt %, a desired toughness may not be obtained and weldability may be reduced.

Silicon (Si)

Silicon (Si) serves as a deoxidizer in the steel and a ferrite stabilizing element that may contribute to ensuring strength and elongation by inhibiting carbide formation in ferrite.

Silicon (Si) is added in an amount of 0.9 wt % to 1.1 wt % based on the total weight of the steel sheet. If the content of silicon (Si) is less than 0.9 wt %, it may be difficult to ensure elongation, and if the content of silicon is more than 1.1 wt %, it may reduce the continuous casting property and weldability of the steel sheet.

Manganese (Mn)

Manganese (Mn) may increase the strength of the steel sheet by strengthening solid solution and increasing hardenability. Manganese (Mn) is added in an amount of 2.2 wt % to 2.3 wt % based on the total weight of the steel sheet. If the content of manganese (Mn) is less than 2.2 wt %, the effect of adding the same cannot be properly exhibited. If the content of manganese (Mn) is more than 2.3 wt %, a manganese band structure may be formed in the thickness-wise center of the material, thereby reducing elongation and bending workability.

Chromium (Cr)

Chromium (Cr) may contribute to increasing the strength of the steel by strengthening solid solution and hardenability. Chromium (Cr) may be added in an amount of 0.35 wt % to 0.45 wt % based on the total weight of the steel sheet. If the content of chromium (Cr) is less than 0.35 wt %, the effect of adding the same cannot be properly exhibited. On the other hand, if the content of chromium (Cr) is more than 0.45 wt %, it may reduce weldability.

Molybdenum (Mo)

Molybdenum (Mo) may contribute to increasing the strength of the steel by strengthening solid solution and hardenability. Molybdenum (Mo) is added in an amount of 0.04 wt % to 0.07 wt % based on the total weight of the steel sheet. If the content of molybdenum (Mo) is less than 0.04 wt %, the effect of adding the same cannot be properly exhibited. On the other hand, if the content of molybdenum (Mo) is more than 0.07 wt %, it may reduce toughness by increasing the amount of martensite.

Antimony (Sb)

Antimony (Sb) may inhibit manganese and silicon from being present as oxides on the surface of the steel sheet. Although antimony (Sb) does not form an oxide layer by the element itself at high temperatures, it may be enriched on the steel sheet surface and at the grain boundary, thereby inhibiting the manganese and silicon of the steel from diffusing to the steel sheet surface. This may control oxide formation around the steel sheet surface. In addition, antimony (Sb) has the effect of inhibiting color difference defects on the cold-rolled steel sheet by inhibiting oxide formation on the steel sheet during the annealing process.

Antimony (Sb) is added in an amount of 0.02 wt % to 0.05 wt % based on the total weight of the steel sheet. If the content of antimony (Sb) is less than 0.02 wt %, the effect of adding the same cannot be properly exhibited. On the other hand, if the content of antimony (Sb) is more than 0.05 wt %, it may deteriorate the physical properties of the steel sheet by reducing ductility.

Aluminum (Al)

Aluminum is added for deoxidation in steelmaking. Aluminum (Al) may bind to the nitrogen of steel to form AlN, thereby refining the steel structure. The content of aluminum (Al) may be 0.35 wt % to 0.45 wt % based on the total weight of the steel sheet. If the content of aluminum is less than 0.35 wt %, a sufficient deoxidation effect cannot be obtained. On the other hand, the content of aluminum is more than 0.45 wt %, it may reduce strength by promoting carbon diffusion in ferrite and austenite.

Phosphorus (P)

Phosphorus (P) may increase the strength of the steel by solid solution strengthening. Phosphorus (P) may be added in an amount of more than 0 wt % but not more than 0.02 wt % based on the total weight of the steel sheet. If the content of phosphorus (P) is more than 0.02 wt %, it may form a steadite of Fe3P, causing hot shortness.

Sulfur (S)

Sulfur (S) may reduce the toughness and weldability of the steel sheet and also reduce bending workability by increasing the amount of non-metallic inclusions (MnS). Sulfur (S) is added in an amount of more than 0 wt % but not more than 0.003 wt % based on the total weight of the steel sheet. The content of sulfur (S) is more than 0.003 wt %, it may deteriorate fatigue characteristics by increasing the amount of coarse inclusions.

Method for Manufacturing High-Strength Cold-Rolled Steel Sheet

Hereinafter, a method for manufacturing a high-strength cold-rolled steel sheet according to one embodiment of the present invention will be described.

Figure 5:
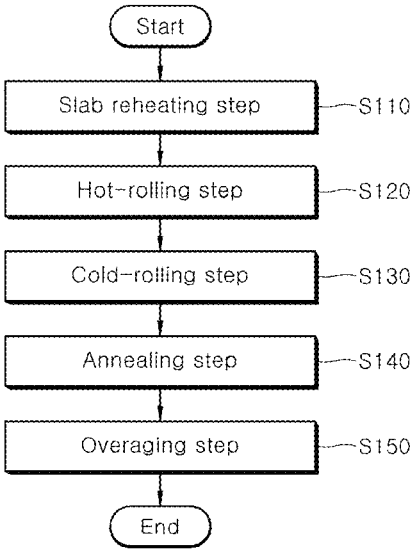
FIG. 5 is a process flow chart showing a method for manufacturing a non-heat-treated hot-rolled steel sheet according to an example of the present invention.

FIG. 5 is a process flow chart showing a method for manufacturing a high-strength cold-rolled steel sheet according to an embodiment of the present invention. Referring to FIG. 5, the method for manufacturing the high-strength cold-rolled steel sheet includes a slab reheating step (S110), a hot-rolling step (S120), a cold-rolling step (S130), an annealing step (S140), and an overaging step (S150). In this regard, the slab reheating step (S110) may be performed to obtain effects such as re-dissolution of precipitates. In the method, a steel slab may be obtained by obtaining a molten steel having a desired composition through a steelmaking process and subjecting the molten steel to a continuous casting process. The sheet slab includes 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), and the remainder being iron (Fe) and inevitable impurities. In another embodiment, the steel slab may further include at least one of 0.35 wt % to 0.45 wt % aluminum (Al), more than 0 wt % but not more than 0.02 wt % phosphorus (P), and more than 0 wt % but not more than 0.003 wt % sulfur (S).

Slab Reheating

In the slab reheating step (S110), the sheet slab having the above-described alloy composition is reheated at a slab reheating temperature (SRT) of 1150° C. to 1250° C. for about 2 to 5 hours. Through this reheating of the steel slab, re-dissolution of components segregated during casting and re-dissolution of precipitates may occur.

If the slab reheating temperature is lower than 1150° C., a problem may arise in that components segregated during casting are not sufficiently uniformly distributed. On the other hand, if the reheating temperature is higher than 1250° C., very coarse austenite grains may be formed, making it difficult to ensure strength. In addition, as the slab reheating temperature increases, heating cost and additional time for adjusting the rolling temperature may be required, thus increasing the production cost and reducing the productivity.

Hot Rolling

The hot-rolling step (S120) is hot-rolled at a finishing mill delivery temperature of 800° C. to 900° C. If the finishing mill delivery temperature (FDT) is lower than 800° C., it may cause a difference in properties along the lengthwise direction of the hot-rolled coil, and on the other hand, if the finishing mill delivery temperature (FDT) is higher than 900° C., austenite grain coarsening may occur, making it difficult to obtain ferrite for ensuring elongation.

The hot-rolled steel sheet is cooled. The cooling may be performed by a method such as natural cooling, forced cooling or the like. The coiling process may be performed at a temperature of 600° C. to 700° C. If the coiling temperature is lower than 600° C., the difference in properties (such as tensile strength) between the widthwise edge and center of the hot-rolled steel sheet may increase. If the coiling temperature is higher than 700° C., sufficient strength may not be ensured. After the coiling process, the difference in tensile strength between the central portion and widthwise edge of the hot-rolled steel sheet may be 50 MPa or less. The hot-rolled steel sheet may have a microstructure composed of pearlite and ferrite.

Cold Rolling

In the cold-rolling step (S130), the hot-rolled steel sheet is cold-rolled to the final thickness of the steel sheet. The reduction ratio of cold rolling may be set at about 50 to 70% depending on the thickness of the hot-rolled steel sheet and the desired final thickness of the steel sheet. Meanwhile, before the cold rolling, a process of performing acid pickling in order to remove scale from the hot-rolled steel sheet may further be included.

Annealing

In the annealing step (S140), the cold-rolled steel sheet is annealed in a two-phase region composed of $\alpha$ and $\gamma$ phases. The annealing may control the austenite phase fraction. In addition, the annealing makes it easy to ensure desired strength and elongation, etc.

To ensure bending workability, the annealing may be performed in a region in which $\alpha$ and $\gamma$ phases coexist, making it easy to ensure soft ferrite. In a specific embodiment, the annealing may be performed by heating at 810° C. to 850° C. for about 30 seconds to 150 seconds. If the annealing temperature is lower than 810° C. or the annealing time is shorter than 30 seconds, sufficient austenite transformation may not occur, making it difficult to ensure the strength of the final steel sheet. On the other hand, the annealing temperature is higher than 850° C. or the annealing time is longer than 150 seconds, the austenite grain size may greatly increase, thus reducing the physical properties (such as strength) of the steel sheet. After completion of the annealing, the annealed steel sheet is cooled to the martensite temperature range. In a specific embodiment, the annealed steel sheet is cooled to a temperature of 250° C. to 350° C. at an average cooling rate of 5° C./sec to 20° C./sec.

Overaging

In the overaging step (S150), the cooled steel sheet is austempered in the martensite temperature range, that is, at a temperature of 250° C. to 350° C. The austempering allows carbon (C) to be enriched into the remaining austenite within a short time, so that a bainite phase may be formed in the final microstructure of the manufactured steel sheet. Here, the overaging may include not only keeping the temperature constant for a predetermined time, but also air cooling for a predetermined time. If the overaging temperature is out of the above-described temperature range, it may be difficult to form and control the bainite phase.

The overaging may be performed for 200 seconds to 400 seconds. If the overaging time is shorter than 200 seconds, the effect of overaging may be insufficient, and if the overaging time is longer than 400 seconds, it may reduce the productivity without any further effect. The overaged steel sheet may be cooled to about 100° C.

Through the above-described processes, the high-strength cold-rolled steel sheet according to one embodiment of the present invention may be manufactured. The cold-rolled steel sheet may finally have a complex structure composed of ferrite, martensite and bainite. In this regard, the sum of the area fractions of the ferrite and the martensite may be 90% to less than 100%.

Examples

Hereinafter, the constitution and effects of the present invention will be described in more detail with reference to preferred examples and comparative examples. However, these examples are given merely as illustrative of the present invention and are not to be construed as limiting the scope of the present invention in any way.

Contents that are not disclosed herein can be sufficiently understood by any person skilled in the art, and thus the description thereof is omitted.

1. Preparation of Samples

As the alloy compositions shown in Table 2 below, the compositions of Comparative Examples and Examples were determined. However, in Table 2 below, alloying elements that are inevitably added to the steel compositions are not shown. The samples of the Examples may include antimony (Sb) as an alloying element. Intermediate materials of the Comparative Examples and the Examples, obtained by casting from the compositions, were reheated at 1200° C., and hot-rolled at a finishing mill delivery temperature of 850° C. Next, the obtained steel sheets were coiled at a temperature of 640° C. Thereafter, the hot-rolled steel sheets were acid-pickled and then cold-rolled, thereby manufacturing cold-rolled steel sheets. The cold-rolled steel sheets were heat-treated under the annealing process conditions and overaging process conditions shown in Table 3 below, thereby finally preparing samples of Comparative Examples 1 to 5 and samples of Examples 1 to 9. For the samples of Comparative Examples 1 to 5, the annealing temperatures were set lower than those for the samples of Examples 1 to 9. The samples of Examples 1 to 9 were set to satisfy the annealing process and overaging process temperature ranges according to the embodiment of the present invention.

TABLE 2

| | Chemical composition (wt %) | | | | | |
|---|---|---|---|---|---|---|
| | C | Si | Mn | Cr | Mo | Sb |
| Comparative Examples | 0.110 | 1.03 | 2.23 | 0.376 | 0.043 | — |
| Examples | 0.114 | 0.968 | 2.177 | 0.39 | 0.05 | 0.026 |

TABLE 3

| | Annealing temperature (° C.) | Overaging temperature (° C.) |
|---|---|---|
| Comparative Example 1 | 800 | 420 |
| Comparative Example 2 | | 500 |
| Comparative Example 3 | | 250 |

TABLE 3-continued

| | Annealing temperature (° C.) | Overaging temperature (° C.) |
|---|---|---|
| Comparative Example 4 | | 300 |
| Comparative Example 5 | | 350 |
| Example 1 | 810 | 250 |
| Example 2 | | 300 |
| Example 3 | | 350 |
| Example 4 | 830 | 250 |
| Example 5 | | 300 |
| Example 6 | | 350 |
| Example 7 | 850 | 250 |
| Example 8 | | 300 |
| Example 9 | | 350 |

2. Evaluation of Physical Properties

For the cold-rolled steel sheet samples of Comparative Examples 1 to 5 and Examples 1 to 9, yield strength, tensile strength, elongation and bending workability were measured, and the results of the measurement are shown in Table 4 below. In addition, whether a color difference on the cold-rolled steel sheet samples of Comparative Examples 1 to 5 and Examples 1 to 9 would occur was observed, and the results are shown in Table 4 below.

TABLE 4

| | Yield strength (MPa) | Tensile strength (MPa) | Elongation (%) | Bending workability (R/t) | Color difference |
|---|---|---|---|---|---|
| Comparative Example 1 | 642 | 1077 | 17 | 2.33 | Occurred |
| Comparative Example 2 | 668 | 1066 | 18 | 2.16 | Occurred |
| Comparative Example 3 | 680 | 1102 | 17 | 2.33 | Occurred |
| Comparative Example 4 | 645 | 1047 | 18 | 2.33 | Occurred |
| Comparative Example 5 | 616 | 1022 | 17 | 2.16 | Occurred |
| Example 1 | 623 | 1066 | 17 | 1.83 | Did not occur |
| Example 2 | 619 | 1043 | 18 | 1.66 | Did not occur |
| Example 3 | 600 | 1022 | 19 | 1.33 | Did not occur |
| Example 4 | 637 | 1032 | 18 | 1.33 | Did not occur |
| Example 5 | 621 | 1055 | 18 | 1.17 | Did not occur |
| Example 6 | 633 | 1070 | 17 | 1.40 | Did not occur |
| Example 7 | 666 | 1100 | 17 | 1.33 | Did not occur |
| Example 8 | 645 | 1085 | 17 | 1.17 | Did not occur |
| Example 9 | 660 | 1075 | 17 | 1.40 | Did not occur |

First, whether a color difference on the cold-rolled steel sheets would occur was observed. As a result, in the samples of Comparative Examples 1 to 5, which did not include antimony (Sb) as an alloying element, the occurrence of a local color difference was observed. In the samples of Examples 1 to 9, which included antimony (Sb) as an alloying element, it was observed that a color difference did not occur.

Regarding yield strength, tensile strength and elongation, the samples of Comparative Examples 1 to 9 and Examples 1 to 9 all satisfied a yield strength of 600 MPa or higher, a tensile strength of 980 MPa or higher and an elongation of 17% or higher, which were desired values. However, regarding bending workability (R/t), Comparative Examples 1 to 5 showed a bending workability of 2 or more, which did not satisfy the desired value, and Examples 1 to 9 satisfied the desired value of 2.0 or less.

Figure 6:
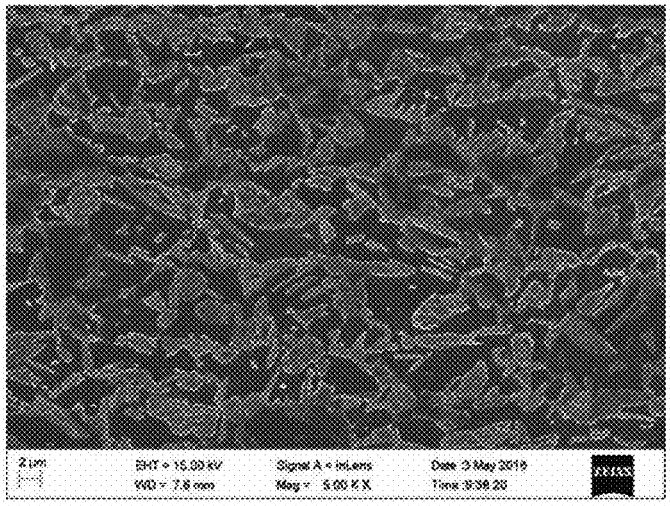
FIG. 6 is a photograph showing the microstructure of a cold-rolled steel sheet according to one example of the present invention.

Meanwhile, FIG. 6 is a photograph showing the microstructure of the cold-rolled steel sheet according to one Example of the present invention. FIG. 6 is a photograph showing the microstructure of the sample of Example 1, and as shown therein, it can be seen that the microstructure is a complex structure having ferrite and martensite as main phases and containing a small amount of bainite.

Although the present invention has been described in detail with reference to the accompanying drawings and the embodiments, those skilled in the art will appreciate that the embodiments disclosed in the present invention may be modified and changed in various manners without departing from the technical idea of the present invention as defined in the appended claims.

What is claimed is:

1. A method for manufacturing a high-strength cold-rolled steel sheet, the method comprising the steps of:

(a) reheating a steel slab, which comprises 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), 0.35 wt % 0.45 wt % aluminum (Al), and the remainder being iron (Fe) and inevitable impurities, at a temperature of 1150° C. to 1250° C. to obtain a reheated slab;

(b) hot-rolling the reheated slab to reach a finishing mill delivery temperature of 800° C. to 900° C. to obtain a hot-rolled slab;

(c) cooling the hot-rolled slab to a temperature of 600° C. to 700° C., followed by coiling, thereby obtaining a hot-rolled steel sheet;

(d) pickling the hot-rolled steel sheet, followed by cold rolling to obtain a cold-rolled steel sheet;

(e) annealing the cold-rolled steel sheet in a two-phase region composed of α and γ phases to obtain an annealed steel sheet; and (f) cooling the annealed steel sheet to a martensite temperature range, followed by overaging.

2. The method of claim 1, wherein the hot-rolled steel sheet after step (c) has a microstructure composed of pearlite and ferrite.

3. The method of claim 1, wherein a difference in tensile strength between a center and widthwise edge of the hot-rolled steel sheet is 50 MPa or less.

4. The method of claim 1, wherein the annealing of step (e) is performed at 810° C. to 850° C., and the overaging of step (f) is performed at 250° C. to 350° C.

5. A high-strength cold-rolled steel sheet consisting of 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), 0.35 wt % to 0.45 wt % aluminum (Al), and the remainder being iron (Fe) and inevitable impurities, the steel sheet having a complex microstructure composed of ferrite, martensite and bainite, wherein a sum of area fractions of the ferrite and the martensite is from 90% up to less than 100%.

6. The high-strength cold-rolled steel sheet of claim 5, having a tensile strength of 980 MPa or higher, a yield strength of 600 MPa or higher, an elongation of 17% or higher, and a bending workability (R/t) of 2.0 or less.

7. A method for manufacturing a high-strength cold-rolled steel sheet, the method comprising the steps of:

(a) reheating a steel slab, which consists of 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), 0.35 wt % to 0.45 wt % aluminum (Al), more than 0 wt % but not more than 0.02 wt % phosphorus (P), more than 0 wt % but not more than 0.003 wt % sulfur (S) and the remainder being iron (Fe) and inevitable impurities, at a temperature of 1150° C. to 1250° C. to obtain a reheated slab;

(b) hot-rolling the reheated slab to reach a finishing mill delivery temperature of 800° C. to 900° C. to obtain a hot-rolled slab;

(c) cooling the hot-rolled slab to a temperature of 600° C. to 700° C., followed by coiling, thereby obtaining a hot-rolled steel sheet;

(d) pickling the hot-rolled steel sheet, followed by cold rolling to obtain a cold-rolled steel sheet;

(e) annealing the cold-rolled steel sheet in a two-phase region composed of α and γ phases to obtain an annealed steel sheet; and (f) cooling the annealed steel sheet to a martensite temperature range, followed by overaging.

8. A high-strength cold-rolled steel sheet consisting of 0.10 wt % to 0.13 wt % carbon (C), 0.9 wt % to 1.1 wt % silicon (Si), 2.2 wt % to 2.3 wt % manganese (Mn), 0.35 wt % to 0.45 wt % chromium (Cr), 0.04 wt % to 0.07 wt % molybdenum (Mo), 0.02 wt % to 0.05 wt % antimony (Sb), 0.35 wt % to 0.45 wt % aluminum (Al), more than 0 wt % but not more than 0.02 wt % phosphorus (P), more than 0 wt % but not more than 0.003 wt % sulfur (S) and the remainder being iron (Fe) and inevitable impurities, the steel sheet having a complex microstructure composed of ferrite, martensite and bainite, wherein a sum of area fractions of the ferrite and the martensite is from 90% up to less than 100%.

* * * * *